US006564415B1

(12) United States Patent
Katakura et al.

(10) Patent No.: US 6,564,415 B1
(45) Date of Patent: May 20, 2003

(54) SURFACE TREATING DEVICE

(75) Inventors: Takaaki Katakura, Kanagawa (JP); Sousaburo Ohara, Tokyo (JP); Akira Miyagi, Tokyo (JP)

(73) Assignee: Taiho Industries Co., Ltd., Tokyo (JP)

( * ) Notice: Subject to any disclaimer, the term of this patent is extended or adjusted under 35 U.S.C. 154(b) by 0 days.

(21) Appl. No.: 09/550,332

(22) Filed: Apr. 14, 2000

(30) Foreign Application Priority Data

Sep. 24, 1999 (JP) ..... 11-269983

(51) Int. Cl.[7] ..... B08B 1/00

(52) U.S. Cl. ..... 15/104.94; 15/104.93; 15/244.1; 15/210.1; 15/228; 15/160; 15/245; 15/258; 206/229; 401/202

(58) Field of Search ..... 15/104.93, 104.94, 15/244.1, 210.1, 214, 219, 228, 160, 245, 220.1, 258, 259, 424, 147.1, 118; 401/202, 262, 261, 146, 130, 148, 196, 205, 264, 267; 206/229; D28/7

(56) References Cited

U.S. PATENT DOCUMENTS 2,230,126 A * 1/1941 Westervelt ..... 15/160
2,459,247 A * 1/1949 Skold ..... 206/229
3,035,299 A * 5/1962 Gordon ..... 15/184
3,860,348 A * 1/1975 Doyle ..... 401/132
3,897,603 A * 8/1975 Brennenstuhl ..... 15/150
4,480,940 A * 11/1984 Woodruff ..... 401/148
4,963,045 A * 10/1990 Willcox ..... 206/440
4,971,220 A * 11/1990 Kaufman et al. ..... 220/811
5,431,098 A * 7/1995 Winston ..... 101/202
5,475,891 A * 12/1995 Rickey ..... 15/104.94
5,493,749 A * 2/1996 Zayas ..... 132/320
5,987,694 A * 11/1999 Large ..... 15/104.94
6,042,286 A * 3/2000 Pazienza ..... 401/175

* cited by examiner

*Primary Examiner*—Robert J. Warden, Sr.
*Assistant Examiner*—Laura C Cole
(74) *Attorney, Agent, or Firm*—Oblon, Spivak, McClelland, Maier & Neustadt, P.C.

(57) ABSTRACT

A surface treating device includes a material of sponge or brush fur that constitutes a treating portion, a plastic holder having a fitting groove, and a pair of plastic plates having inside clamping structures. The pair of plastic plates with one end of the material clamped between the inside clamping structures thereof are forced into and fixed in the fitting groove of the plastic holder.

1 Claim, 4 Drawing Sheets

SURFACE TREATING DEVICE

BACKGROUND OF THE INVENTION

1. Field of the Invention

The present invention relates to a surface treating device formed by assembling a small number of members having simple configuration, that can be used as a lustering-agent applicator used for lustering car bodies and tires, furniture, etc. as well as a sweeper, a cleaner, an eraser for a blackboard etc., a squeegee for glass etc. or other such device.

2. Description of the Prior Art

A great number of brushes or applicators having a grip to be held by a user have heretofore been proposed. Their major structural feature is that a material such as fur or felt is adhered to a holder portion of the grip by means of an adhesive agent. The brushes or applicators cannot be used until the adhesive agent sets, because the material easily falls out of the holder portion before the adhesive agent sets. Therefore, a step of setting the adhesive agent (allowing it to stand) is required. In addition, the adhesive agent contains an organic solvent that is flammable and harmful to the human body. Therefore, it is necessary to install an exhausting unit and pay strict attention to fire prevention. For these reasons, the productivity thereof is not good.

Various structures using no adhesive agent also have heretofore been proposed. One example is as shown in FIG. 7 in which one end of felt 6 is clamped between a holder portion at the distal end of a grip 7 and a presser plate 8 by means of rivets 9. With this structure, however, it is necessary to form a plurality of through holes for the rivets 9 in the holder portion and presser plate 8, make the grip 7 and presser plate 8 from a hard material and subject the ends of the rivets 9 to welding. Another example is disclosed in JP-A 11-42193, wherein a wiper cloth is clamped between two members openably connected via a hinge by applying the wiper cloth to the open members and closing the members together. Since this structure is very complicated, the productivity thereof is not good.

Thus, in the brushes or applicators not using adhesive agent, since the component parts have complicated shapes and the assembling work requires special treatments, the productivity thereof is not good. Moreover, the production cost is too high for use of the brushes or applicators as disposable ones.

On the other hand, the work for lustering car bodies or tires or preventing water drops from adhering to windshields is to coat a treating agent onto a surface to be treated. A car owner has to assemble a set of materials including an applicator such as a spongy member, a treating agent, a container for the treating agent and disposable gloves for carrying out this work. This set is bulky and takes up a large space. If always kept in a car trunk, it is likely to be a nuisance, especially if not frequently.

In recent years, water-drop-adherence preventing devices to solve such a problem have been commercially available. These have a structure such that a cap for a container filled with a treating agent is provided inside with a web member. However, After several uses of such devices, contaminants accumulating in the web member nix with the treating agent, resulting in adherence of stains to windshields coated with the treating agent using the web member.

In view of the above, the present invention has an object to provide a surface treating device that can be fabricated with ease using a small number of members of simple structure and used as a disposable one.

SUMMARY OF THE INVENTION

To attain this object, the present invention provides a surface treating device comprising a material of sponge or brush fur that constitutes a treating portion, a plastic holder having a fitting groove, and a pair of plastic plates having inside clamping structures, wherein the pair of plastic plates with one end of the material clamped between the inside clamping structures thereof are forced into and fixed in the fitting groove of the plastic holder.

In this surface treating device, the plastic holder may have a material-fixing portion in which the fitting groove is formed and around which a removable flange extends, and a cover member that comprises a bulged portion for covering the treating portion and a fitting flange joined to the removable flange. The cover member serves to prevent the volatilization and outflow of a liquid occluded in the material in the storage state of the device and, in use of the device, can be removed together with the removable flange by breaking off the removable flange. Therefore, this surface treating device is very practicable.

As described above, the surface treating device according to the present invention comprises a material constituting a treating portion, a pair of plastic plates and a plastic holder. Since these component members each have a simple structure, the productivity thereof is very high. Furthermore, since these component members can be assembled with ease into a surface treating device without use of adhesive agent or execution of welding treatment, the device productivity is also very practicable.

While easy-to-peel adhesive has been adopted between the cup and the cover for various liquid-phase foods, no such adhesive is used in the wet-type surface treating device according to the present invention, that has a liquid occluded in the material constituting the treating portion. High productivity can therefore be attained. The easy-to-peel adhesive used in food containers is required to have both sealability to prevent bleeding of the contained liquid-phase food and an easy-to-peel property of the cover relative to the cup. These two properties are difficult to balance. If one is enhanced, the other tends to degrade. On the other hand, in the present invention, the sealability between the fitting flange and the removable flange is high because the two flanges are joined together, and the cover member can be easily removed by breaking off the removable flange, with the joined section left intact.

The above and other objects, characteristic features and advantages will become apparent from the description to be made in detail with reference to the accompanying drawings.

DESCRIPTION OF THE PREFERRED EMBODIMENTS

Figure 1:
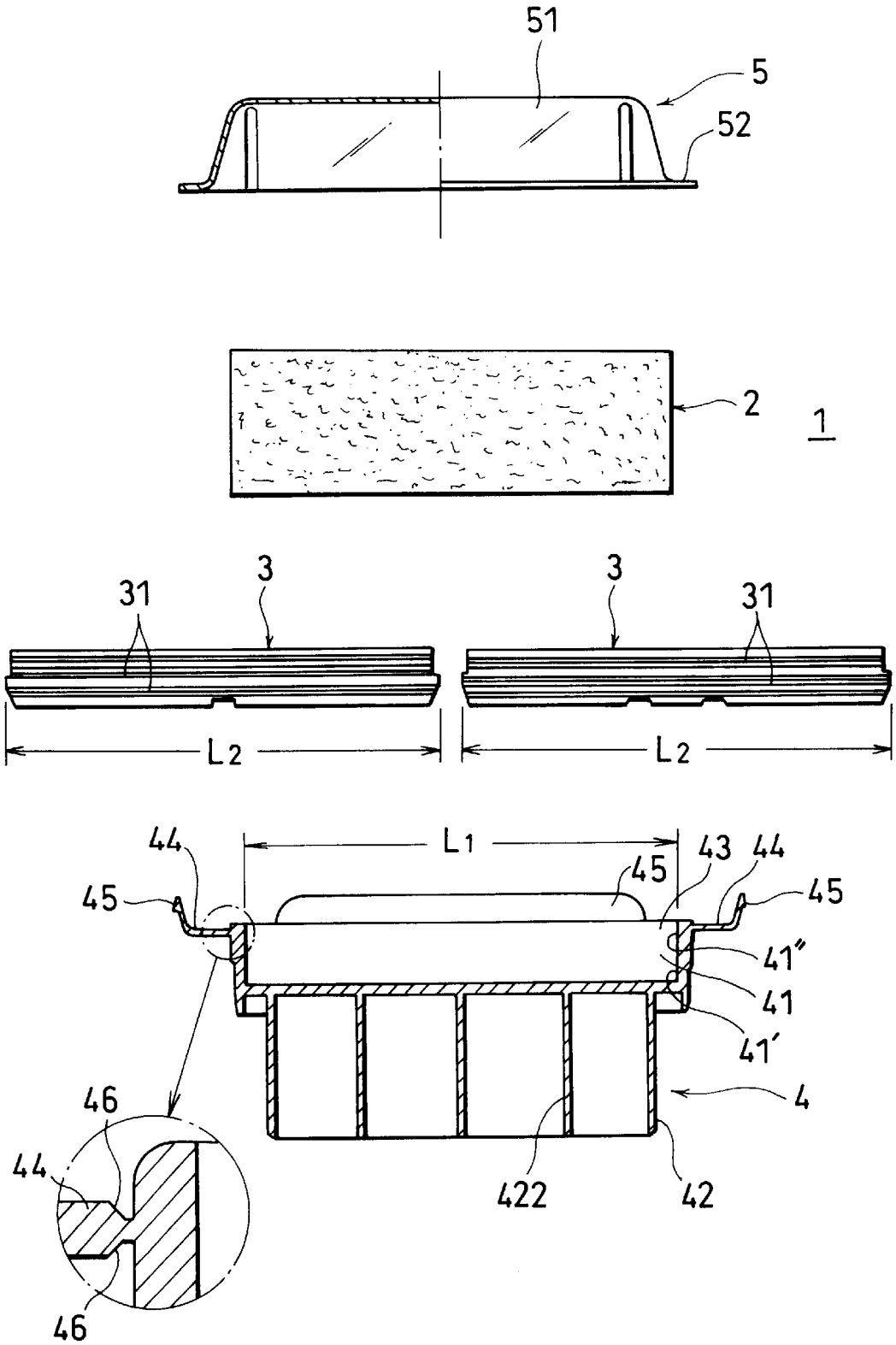
FIG. 1 is an exploded front view showing a first embodiment of the surface treating device according to the present invention, with an inset showing a partial enlarged view of the proximal end of a removable flange.

The surface treating device according to the present invention will now be described in detail with reference to the embodiments shown in the drawings.

FIGS. 1 to 4 illustrate the first embodiment of the surface treating device 1 according to the present invention. The device 1 is an applicator for applying a lustering agent to car tires and fundamentally comprises a material 2 constituting a treating portion 21 brought into contact with a surface to be treated, a pair of plates 3 and a holder 4.

As shown in FIG. 1, the material 2 is a rectangular, soft, continuously foamed body (sponge) of urethane etc. and occludes a lustering agent (liquid) therein. A cover member 5 can be used, when necessary, for covering the material 2 to prevent volatilization and outflow of the lustering agent occluded in the material 2. The cover member 5 is an integral molding of transparent plastic comprising a bulged portion 51 for covering the material 2 and a fitting flange 52.

The pair of plates 3 are thin strip moldings of plastic provided on their respective facing surfaces with a clamping structure 31. The clamping structure 31 comprises two rows of ridges triangular in cross section.

The holder 4 is an integral molding of plastic comprising a hollow cylindrical grip portion 42 and a fixing portion 43 substantially rectangular in cross section, that is disposed on the grip portion 42 and provided with round corners. The fixing portion 43 is formed with a slender fitting groove 41. The surfaces of the fixing portion 43 defining the fitting groove 41 are flat. The grip portion 42 is formed on the outside surface thereof with nonslip projections 421 (FIG. 3) and inside thereof with reinforcing ribs 422.

The length $L_2$ of the lower end of each plastic plate 4 is set to be slightly larger than the length $L_1$ of the fitting groove 41 in the fixing portion 43 of the holder 4.

Figure 2:
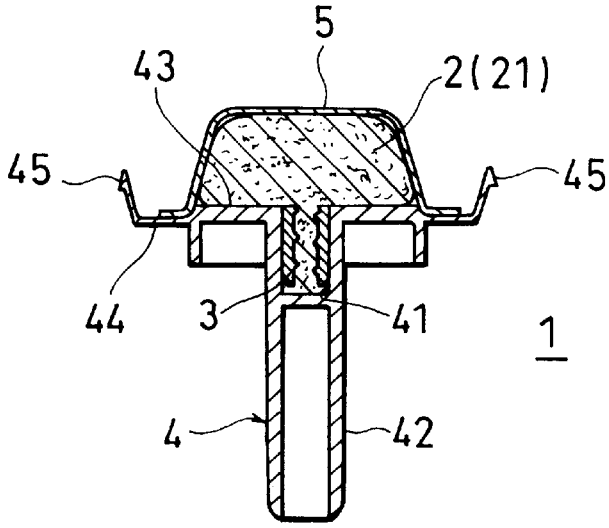
FIG. 2 is a cross-sectional side view showing the surface treating device of FIG. 1 after fabrication.
Figure 4:
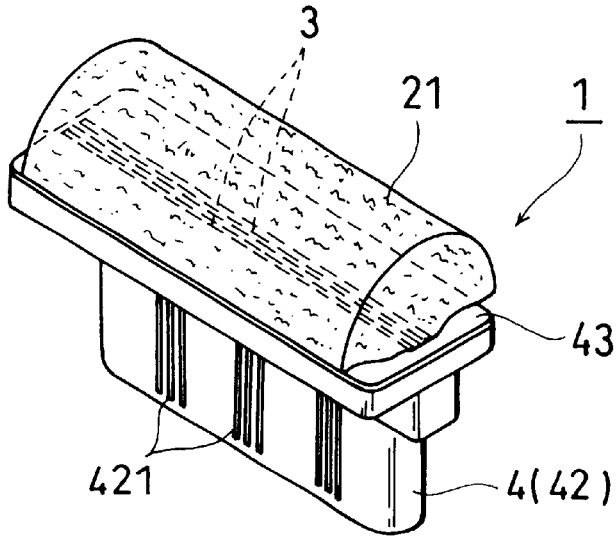
FIG. 4 is a perspective view showing the surface treating device of FIG. 1.

One end of the material 2 is clamped between the clamping structures 31 of the pair of plates 3 to form a substantially semi-cylindrical treating portion 21 as shown in FIG. 2 and FIG. 4. In this state, the pair of plastic plates 3 are forced in the fitting groove 41 in the fixing portion 43, thereby fixing the material 2 (treating portion 21) to the fixing portion 43 of the plastic holder 4.

Since the applicator in this embodiment is a wet-type surface treating device 1 having the material 2 occluding a liquid substance therein, sponge is used as the material 2. However, this is by no means limitative. The material 2 may be brush fur, cloth or other such material when the device 1 is of a dry type such as a brush or a sweeper (e.g. a blackboard eraser or a duster), as in other embodiments described later. Otherwise, felt, fiber web, nonwoven fabric or like material can be substituted. Thus, the material 2 is optionally determined and the shape thereof is also optional. Furthermore, the clamping structure 31 is not limited to the ridges triangular in cross section. It may be comprised of a plurality of conical or pyramidal splinters, or of a bump on one of the facing surfaces of the plastic plates 3 and a recess in the other facing surface thereof. Any other form of clamping structure 31 can be adopted insofar as one end of the material 2 can be clamped.

The first embodiment will be described hereinafter in more detail.

A thin removable flange 44 extends outward from the peripheral surface of the fixing portion 43 of the holder 4 at a position slightly lower than the top surface of the fixing portion 43 and has a shape provided with four round corners similarly to the fixing portion 43. It has substantially the same dimensions as the fitting flange 52 of the cover member 5 and is provided with four rising tabs 45 directed toward the treating portion 21. The rising tabs 45 are the portions to which the user applies a finger (the bulb of the finger) to push the rising tab 45 inward in order to snap and remove the removable flange 44. Since the removable flange 44 is thin, in the absence of these rising tabs 45 there is a possibility of the edge of the removable flange 44 biting into the finger bulb and causing pain. The rising tabs 45 further function to regulate the position of the cover member 5 when the cover member 5 and the holder 4 are joined together and, before the use of the surface treating device 1, serve to enhance the strength of the removable flange 44 and protect the cover member 5.

Figure 3:
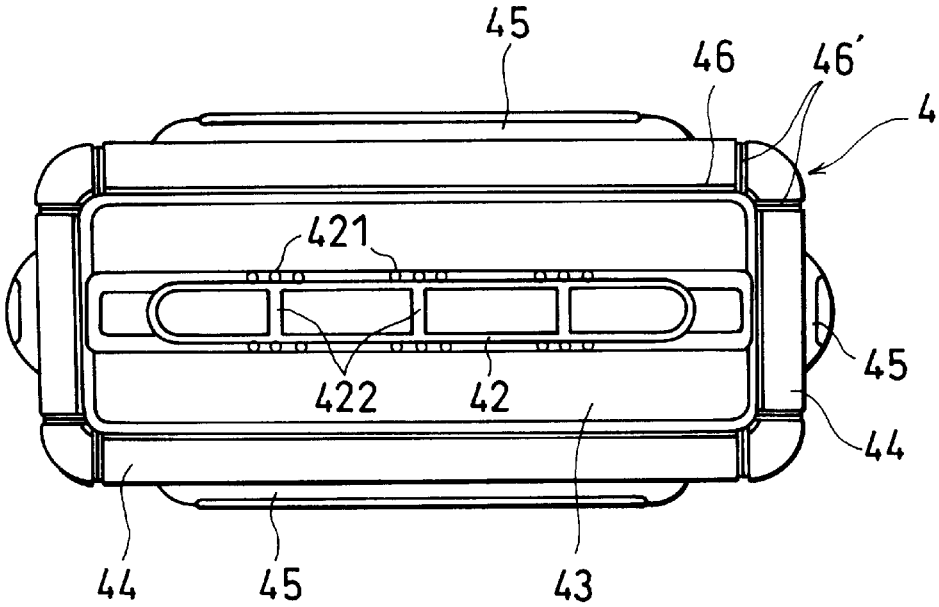
FIG. 3 is a bottom view showing the surface treating device of FIG. 1.

At the proximal end, the removable flange 44 is formed on the obverse and reverse sides thereof with notches 46 At each round corner on the reverse side thereof, it is formed with two linear notches 46'. As shown in FIG. 3, a fanlike shape is defined at the reverse side of each round corner by an arcuate segment of the notch 46 and the two linear notches 46'.

The surface treating device 1 is fabricated by assembling together the material 2 constituting the treating portion 21, pair of plates 3, holder 4 and cover member 5 each having a simple structure. This assemblage is easily conducted by clamping the lower end of the material 2 between the pair of plates 3 and forcing the plates 3 in that state into the fitting groove 41 to fix the material 2 integrally to the holder 4.

As explained above, the lower end length $L_2$ of each plastic plate 3 is set to be slightly larger (by an "interference amount") than the length $L_1$ of the fitting groove 41. Therefore, the plates 3 between which the lower end of the material 2 has been clamped are forcibly inserted (interference-fitted) into the fitting groove 41. After the insertion of the plates 3, the opposite lower side edges of the plates 3 bite into the inside wall of the fixing portion 43 of the holder 4 defining the fitting groove 41, owing to elastic deformation of the plates 3, thereby attaining firm fixation between the holder 4 and the plates 3. it is a property of plastic that when elastically deformed plastic is left standing for several days, it creeps into non-restorable plastic deformation. For this reason, mere interference-fitting would result in a decrease in retention force of the holder due to interference amount reduction with the elapse of time. In the present invention, therefore, since the lower portion of each plate 3 has a projecting shape, when the plates 3 creep, the fitting groove 41 is deformed into a shape such that the bottom portion 41" thereof is spread while the entrance portion 41" thereof is not spread. This can suppress decrease in the resistance of the plates 3 in their extraction direction, thereby maintaining large retention force of the holder 4 over a long period of time. Although there is a possibility of the inserted plates 3 being slightly bent within the fitting groove 41, this will raise no problem because the force of the plates 3 clamping the material 2 becomes larger.

A lustering agent is then occluded in the treating portion 21, and the fitting flange 52 of the cover member 5 and the removable flange 44 of the holder 4 are joined together by welding or other such means.

In the surface treating device 1 of the present invention thus fabricated, volatilization or outflow of the lustering agent occluded in the treating portion 21 can be prevented by the cover member 5 when not in use. In operation, the cover member 5 can be easily removed together with the removal flange 44 by snapping off the proximal end (notches 46) of the removal flange 44.

To be specific, the user pushes each rising tab 45 formed on the outer periphery of the removable flange 44 inward with a finger. As a result, the removable flange 44 is snapped off at the notches 46. Since the removable flange 44 is disposed at a position slightly lower than the top surface of the fixing portion 43, any burrs if formed in consequence of the snapping-off action are at a position lower than the top surface of the fixing portion 43. Further, since the round corners of the removable flange 44 are formed on the reverse side with the linear notches 46', these can be snapped off along the arcuate segments of the notches 46. Any burrs if formed at the round corners are very small in number and size. Therefore, the finger tip is safe from injury by formed burrs. Thus, safety can be highly ensured.

The cover member 5 can thus be removed into the state of FIG. 4. By grasping the grip portion 42 of the holder 4 and bringing the treating portion 21 against an automobile tire, the treating portion 21 is sandwiched between the tire and the fixing portion 43. The lustering agent occluded in the treating portion 21 consequently oozes out and is applied onto the tire surface.

The action of the plates 3 will be described in detail with reference to the comparative examples of surface treating devices shown in FIGS. 8 and 9.

Figure 8:
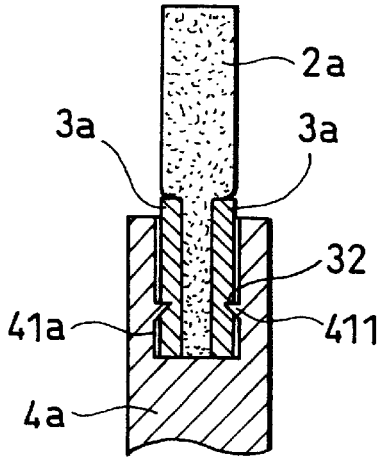
FIG. 8 is a cross-sectional side view showing a comparative example of the surface treating device.

The surface treating device of FIG. 8 is configured such that each of plates 3*a* is formed on the outside surface thereof with an engaging recess 32 while the inside wall of a holder 4*a* defining a fitting groove 41*a* is formed with a pair of opposite engaging projections 411, whereby the engaging projections 411 engage in the engaging recesses 32. This configuration has a fundamental defect in that a material 2*a* is susceptible to easy fall-out from between the plates 3*a*. In order to avoid such dropout, it is required to greatly increase the compression force of the plates 3*a* within the fitting groove 41*a* relative to the material and make the width dimension of the fitting groove 41*a* highly precise. Formation of such fitting groove 41*a* is difficult and insertion of the plates 3*a* into such fitting groove 41*a* is very difficult.

Figure 9:
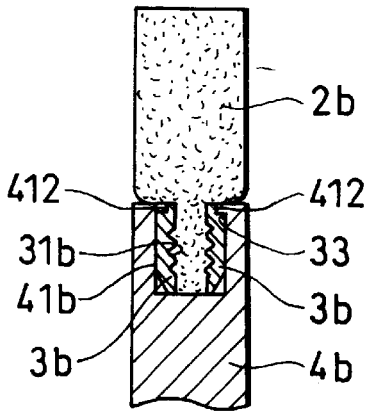
FIG. 9 is a cross-sectional side view showing another comparative example of the surface treating device.

In the surface treating device of FIG. 9, since a pair of plates 3*b* are formed on their face-to-face surfaces with clamping structures 31*b*, a material 2*b* is less susceptible to dropout from between plates 3*b* than in the comparative example of FIG. 8, and insertion of the plates 3*b* into a fitting groove 41*b* is easier than that in the comparative example of FIG. 8. In the comparative example of FIG. 9, however, the upper outside surface of each plate 3*b* is formed with parts 33 to be stopped by stopper flanges 412 formed on the upper wall portion of a holder 4*b* defining the fitting groove 41*b*. Therefore, formation of such fitting groove 41*b* is difficult, similarly to that in the FIG. 8 comparative example.

On the other hand, in surface treating device of the present invention, dropout of the material 2 is prevented by the clamping structures formed on the face-to-face surfaces of the pair of plates 3, and dropout of the plates 3 is prevented by setting the lower end length $L_2$ of the plates 3 to be slightly larger than the length $L_1$ of the fitting groove 41. In addition, neither the engaging projections 411 of the FIG. 8 comparative example nor the stopper flanges 412 of the FIG. 9 comparative example are formed in the fitting groove 41 of the present invention. Therefore, molding of the plates 3 and the fitting groove 41 is very easy.

That is to say, in the present invention, dropout of the material 2 is prevented by the clamping force of the plates 3 in the width direction of the fitting groove 41, and dropout of the plates 3 is prevented by the spreading force of the plates in the length direction of the fitting groove 41. For this reason, the strength of integration of the material 2 and the plates 3 each relative to the holder 4 in the present invention is much higher than that in the comparative examples of FIGS. 8 and 9 in which the dropout of both the material 2*a* (2*b*) and the plates 3*a* (3*b*) is prevented by the force in the width direction of the fitting groove 41*a* (41*b*). In addition, the plates 3 and the holder 4 with the fitting groove 41 can be molded from plastic with ease. Moreover, the plates 3 can easily be inserted into the fitting groove 41.

Figure 5:
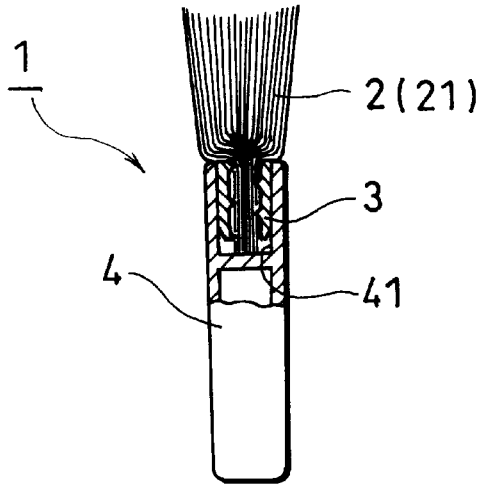
FIG. 5 is a partially sectioned side view showing a second embodiment of the surface treating device according to the present invention.

FIG. 5 shows the second embodiment of the surface treating device according to the present invention, that is a handy brush 1 (a dry-type surface treating device) in which a material 2 constituting a treating portion 21 is made of brush fur.

The handy brush 1 has substantially the same structure as the lustering agent applicator in the first embodiment except for the nature of the material 2. Nonsubstantial differences include that a fixing portion 43 of a holder 4 is thinner and that neither the removable flange 44 nor the cover member 5 is provided.

The assembly into the handy brush 1 can be achieved by clamping the lower end of the material 2 between a pair of plates 3 and thrusting the pair of plates 3 in that state into a fitting groove 41 in the fixing portion 43.

Figure 6:
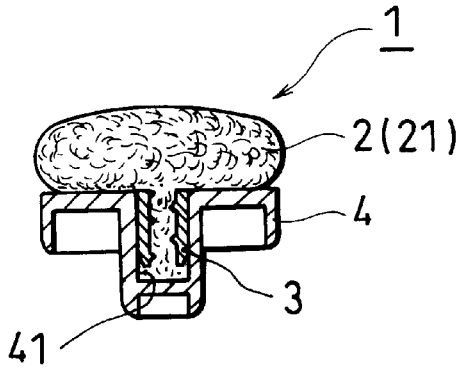
FIG. 6 is a cross-sectional side view showing a third embodiment of the surface treating device according to the present invention.
Figure 7:
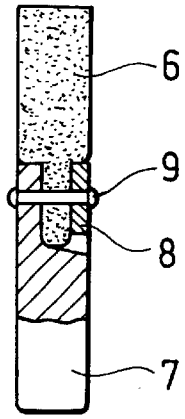
FIG. 7 PRIOR ART
FIG. 7 is a partially sectioned side view showing a prior art surface treating device.

FIG. 6 shows the third embodiment of the surface treating device according to the present invention, that is a blackboard eraser 1 (a dry-type surface treating device) in which a material 2 constituting a treating portion 21 is cloth.

The blackboard eraser 1 has substantially the same structure as the lustering agent applicator in the first embodiment except for the nature of the material and the shape of a grip portion 42, but neither the removable flange 44 nor the cover member 5 is provided.

The assembly into the blackboard eraser 1 can be effected in the same manner as in the first and second embodiments.

As has been described in the foregoing, the surface treating device according to the present invention comprises a material constituting a treating portion, a pair of plates and a holder, the structures of which are very simple, resulting in high productivity. In assembling these component members, adhesive agent, welding operation and other such means or operation that have heretofore been adopted are not required. Therefore, no special apparatus or equipment is required, resulting in safety for operators and high practical utility.

Although the lustering agent applicator has been illustrated as a wet-type surface treating device, other wet-type surface treating devices such as a water-drop adherence preventing device for automobile windshields, a broad marker pen for signboards, a cleaning device, etc. can be realized by changing the kind of the material of the treating portion and changing the kind of liquid occluded in the material. When a cover member is adopted for the wet-type surface treating devices, since a fitting flange of the cover and a removable flange of a holder are joined together, the liquid occluded in the material can be tightly sealed. In use, the removable flange and the cover member can be removed with ease by snapping off the removable flange. Therefore, the wet-type surface treating devices can be advantageously used as disposable ones.

Although the handy brush and blackboard eraser have been illustrated as dry-type surface treating devices, other dry-type surface treating devices such as a squeegee for windows, etc. can be realized by changing the material to hard rubber or the like.

Thus, the surface treating device according to the present invention has a variety of applications.

Although the present invention has been described and illustrated in detail, it is to be clearly understood that the same is intended by way of illustration and example only and is not to be taken by way of limitation. Therefore, the spirit and scope of the present invention are to be limited only by terms of the appended claims and equivalents thereto.

What is claimed is:

1. A surface treating device comprising:

a material that constitutes a treating portion, a plastic holder having a fitting groove, and a pair of plastic plates having inside clamping structures, wherein the pair of plastic plates with one end of the material clamped between the inside clamping structures thereof are forced into and fixed in the fitting groove of the plastic holder wherein the material has liquid lustering agent or liquid detergent occluded therein, and the plastic holder has a fixing portion in which the fitting groove is formed and a removable flange that extends outward from a peripheral surface of the fixing portion, and further comprising a cover member comprising a bulged portion for covering the treating portion and a fitting flange joined to the removable flange of the plastic holder to prevent volatilization and outflow of the liquid lustering agent or liquid detergent, and wherein the removable flange and the cover member are removable together by snapping off the removable flange in preparation for use.

* * * * *